US005207184A

United States Patent [19]

Kreider

[11] Patent Number: 5,207,184

[45] Date of Patent: May 4, 1993

[54] BOILER BUCKSTAY SYSTEM FOR MEMBRANDED TUBE WALL END CONNECTION

[75] Inventor: Edward W. Kreider, Wadsworth, Ohio

[73] Assignee: The Babcock & Wilcox Company, New Orleans, La.

[21] Appl. No.: 862,866

[22] Filed: Apr. 3, 1992

[51] Int. Cl.[5] ..... F22B 37/24

[52] U.S. Cl. ..... 122/510; 165/82; 122/511

[58] Field of Search ..... 122/510, 511, 6 A; 52/714; 165/82

[56] References Cited

U.S. PATENT DOCUMENTS

| | | | |
|---|---|---|---|
| 2,333,777 | 11/1943 | Godshalk | 122/6 |
| 2,655,238 | 10/1953 | Langvand | 189/34 |
| 2,700,375 | 1/1955 | Godshalk et al. | 122/6 |
| 2,773,487 | 12/1956 | Walter et al. | 122/6 |
| 2,948,267 | 8/1960 | Koch et al. | 122/481 |
| 3,007,455 | 11/1961 | Lieb et al. | 122/6 |
| 3,173,405 | 3/1965 | Evans | 122/510 |
| 3,301,225 | 1/1967 | Boe et al. | 122/510 |
| 3,479,994 | 11/1969 | Kreider et al. | 122/494 |
| 4,008,691 | 2/1977 | Kreider et al. | 122/494 |
| 4,059,075 | 11/1977 | Ssinegurski et al. | 122/6 A |
| 4,395,860 | 8/1983 | Semyanko | 52/714 |
| 4,499,860 | 2/1985 | Loomis et al. | 122/510 |
| 4,721,069 | 1/1988 | Kreider | 122/511 |
| 5,136,985 | 8/1992 | Krowech | 122/510 |

OTHER PUBLICATIONS

B&W Plant Service Bulletin PSB-28 2M P1/88-"Membraned Wall Corner Tube Failures"-The Babcock & Wilcox Company.

Steam: Its Generatin and Use - ©1975-The Babcock & Wilcox Company-pp. 12-5, 12-6,16-1 to 16-9, 17-0, 17-1.

*Primary Examiner*—Edward G. Favors

*Attorney, Agent, or Firm*—Vytas R. Matas; Robert J. Edwards; Eric Marich

[57] ABSTRACT

A buckstay system for a membraned-tube wall having a first wall section which meets a second wall section at an angle to form a corner, utilizes the natural load carrying ability of membraned tube wall construction to simplify or eliminate structural components previously utilized at such locations. Some embodiments use the membraned-tube wall corner configuration alone, or in combination with corner reinforcing plates and/or stiffening members to distribute combustion gas pressure loads to adjacent membrane-wall panels. Other aspects provide reinforcement only to accommodate transient overpressure conditions.

13 Claims, 9 Drawing Sheets

FIG.5
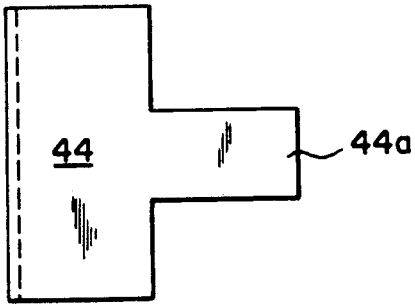
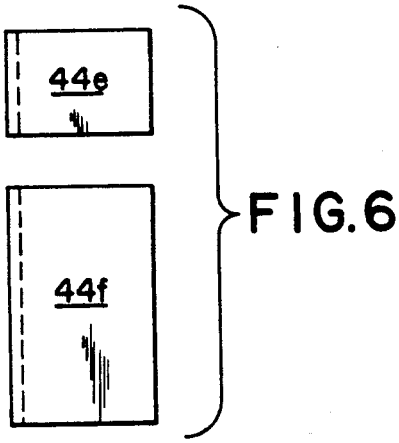
FIG.7
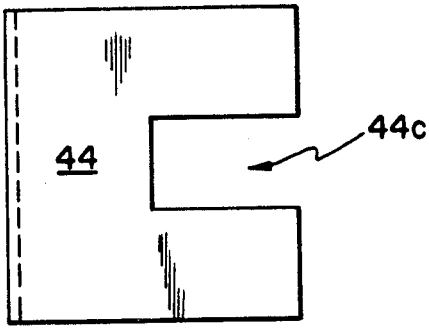
FIG.9
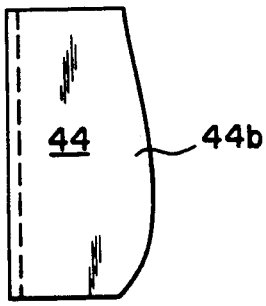
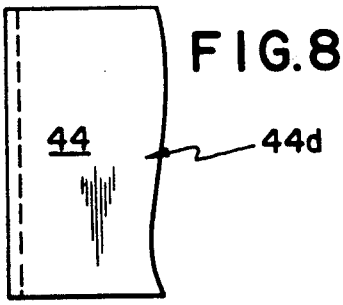
FIG.8

BOILER BUCKSTAY SYSTEM FOR MEMBRANDED TUBE WALL END CONNECTION

FIELD AND BACKGROUND OF THE INVENTION

The present invention relates in general to the support structure for so-called membraned-tube walls in boilers and, in particular, to a new and useful buckstay system for supporting the membraned-tube walls in such a way that tube failures are reduced, particularly those failures which occur because of boiler start up and cool down operations.

Boiler buckstay systems are constructed of rolled steel members and/or trusses that stiffen the boiler tube walls. The boiler tube walls are subjected to combustion gas pressures which can be either positive or negative with respect to the local atmospheric pressure. The combustion gas pressure is contained by connecting the buckstays on opposite walls by bars, rods or channels to balance the resulting tension loads (pressure firing) or compression loads (balanced-draft firing). Thermal expansion of the boiler walls is usually accommodated by various designs of links, slotted members, bolts and pins making the connection between the bars, rods or channels and the buckstays. For a general discussion of this area, the reader is referred to chapters 12 and 16 of *STEAM: Its Generation and Use,* Copyright 1975 by The Babcock & Wilcox Company.

A brief discussion of the structures to which the present invention is applicable can be had by referring to FIGS. 1 and 2 of the present disclosure. FIGS. 1 and 2 are perspective views of a conventional boiler corner construction in the "cold" position—i.e., the boiler pressure parts and structural members are at ambient temperature. A first wall section 10 meets a second wall section 12 at an angle to form a corner 14. Each wall section 10, 12 is comprised of multiple vertically extending tubes 16 which are spaced from and welded to each other by membrane plates 18. Fluid conveyed through the tubes 16 during boiler operation absorbs heat from the combustion gases. A buckstay system is provided on the outside of the walls 10, 12, and comprises at least one buckstay 20, 22 for each wall section 10, 12, respectively. In an actual boiler construction, buckstays 20, 22 are repeated at intervals along the vertical height of the wall sections 10, 12. The buckstays 20, 22 resist bending forces which the wall sections 10, 12 experience during boiler steady state and transient operating conditions. These bending forces are due to both external loads, such as wind and earthquake, and to boiler gas side pressure, which can be either positive or negative with respect to local atmospheric pressure.

Standoff means in the form of support lugs 24 and standoffs 26 are engaged along an inner flange 28 of each buckstay 20, 22. Relative sliding movement between the standoff means 24, 26 and the buckstays 20, 22 is permitted to accommodate thermal expansion.

In FIG. 1, two continuous tie bars or channels 30 are welded to the edge of each standoff 26. Engagement means in the form of L-shaped engagement lugs 32 are welded to the outside surface of some of the horizontally spaced tubes 16 forming each wall section 10, 12. The engagement lugs 32 are welded in facing pairs to form a slot which closely receives each continuous tie bar or channel 30. The engagement means can also comprise a pair of clips as shown in the sub-illustration, one located above and the other below each continuous tie bar or channel 30, together with a tie bar pin. The clip is welded to two adjacent tubes 16 to form a loop that extends out beyond the outer surface of the continuous tie bar or channel 30. When the tie bar pin is inserted between the loop and the continuous tie bar 30, the latter is held in place against the wall sections 10, 12. The engagement means thus supports the weight of the buckstays 20, 22 which, in effect, hang on the wall sections 10, 12.

An end connection corner tie 34 spans the corner 14 and is welded to the continuous tie bars or channels 30. An end connection buckstay bracket 36 is welded to each end of the buckstays 20, 22 near the corner 14. A pair of end connection links 38 is pivotally connected by pins 40 between the end connection corner tie 34 and each end connection buckstay bracket 36. Suitable circular holes are provided in each member 34, 36, 38 for this purpose to allow for thermal expansion of the wall sections 10, 12. To explain, FIGS. 1 and 2 show the corner construction in a "cold" position before the tube wall sections 10, 12 have expanded. In this condition, each link 38 forms a small acute angle with the edge of its buckstay 20, 22 (the edge extending perpendicular to the plane of the wall sections 10, 12). In a "hot" condition, each of the links 38 would extend approximately parallel to the edge of its buckstays 20, 22, and the forces from one wall section 10, for example, would be transmitted to the buckstay 22 of the adjoining wall section 12.

Boiler walls constructed of welded membraned-tube panels (tubes are welded together in various geometric patterns) can be utilized to balance the combustion gas pressure loads between opposite walls in lieu of bars, rods and/or channels. Referring to FIG. 2, one such design utilizes a paddle tie 42 (a short bar welded to an adjacent boiler wall instead of a continuous bar), to connect the buckstays to adjacent membraned-tube walls that carry the buckstay system tension or compression loads. FIG. 2 thus differs from FIG. 1 in that the two continuous tie bars or channels 30 are replaced by a support bar or channel 30' separated from a corner paddle tie 42 welded at the corner 14 to the tubes 16 forming the wall section 10. A continuous tie bar or channel 30 is still provided on the wall section 12.

Buckstay systems with continuous tie bars, rods or channels on membraned-tube walls experience temperature differentials between the tie bars, etc., and tube walls that are of sufficient magnitude to cause failure in the tube walls and/or buckstay system during transient operation of the boiler (start up and cool down).

Buckstay systems with paddle ties have relatively few temperature differential problems. However, it is difficult and, sometimes, impossible to distribute large, concentrated combustion gas pressure loads from the rolled members, etc. through the short bars into the adjacent membraned-tube wall.

Some buckstay and membraned-tube wall attachment structures are disclosed in U.S. Pat. Nos. 4,721,069; 4,499,860; 4,395,860; and 4,059,075. While these references disclose mechanisms for accommodating expansion and contraction of the membraned-tube wall, they do not teach an arrangement for avoiding failures in the wall near a corner of the wall construction.

Corner support arrangements for a membraned-tube wall are disclosed in U.S. Pat. Nos. 4,008,691 and 3,479,994 in conjunction with solid structures that extend across the corner.

SUMMARY OF THE INVENTION

The purpose of the present invention is to eliminate (1) tube failures and (2) buckstay system, component-part failures that occur as a result of boiler start up and cool down, due to temperature-differential caused movements between the membraned tube walls and the buckstay system. This is done, according to one aspect of the invention, by utilizing the natural load carrying ability of membraned tube wall construction to simplify or eliminate the structural components previously utilized at such locations. Some embodiments of the invention utilize the membraned-tube wall corner configuration alone to distribute the combustion gas pressure loads from one wall to an adjacent one. In some situations, it may be necessary to stiffen the boiler membraned-tube walls and contain combustion gas pressure loads on the boiler membraned-tube walls to eliminate failures due to differential expansion-contraction movements between the membraned-tube walls and the buckstays of the system. Other aspects of the present invention involve reinforcing the membraned-tube wall corner configuration with single or multiple corner plates of various geometries together with the stiffening members to facilitate distribution of combustion gas pressure loads to adjacent membrane-wall panels. Still other aspects involve modifications to provide reinforcement only during transient overpressure conditions.

It is a constant goal of boiler makers and the utility industry to improve the availability of their power generation equipment. Tube failures require the boiler to be removed from service which is costly in itself but especially so relative to the resulting lost generation of power. Eliminating tube failures is a major part of boiler availability improvement. The present invention can reduce or eliminate tube failures in boiler membrane-walls due to excessive stress levels caused by start up and cool down temperature induced differential movements between the walls and the boiler buckstay system. Buckstay system parts failures can also be reduced or eliminated. The invention will have the most effect on once-through boilers due to their ability to be force-cooled. However, the present invention would also apply to natural circulation, i.e., drum-type boilers since tube failures have also been experienced in membraned-tube walls of drum-type boilers. It can be used on new boiler as well as on existing boilers to resolve problems or as part of the extensive upgrade work now prevalent throughout the utility industry.

Accordingly, one aspect of the present invention is to provide a buckstay system for a membraned-tube wall of a steam generator having a first wall section which meets a second wall section at an angle to form a corner. and which utilizes the natural load carrying ability of membrane wall construction alone to facilitate distribution of combustion gas pressure loads to adjacent membrane wall panels. At least one buckstay extends across at least part of each wall section. Standoff means are engaged with each buckstay and extend toward each respective wall section. A support bar is connected to the standoff means of each buckstay, each support bar being engaged against and along at least part of the length of each respective wall section and having an end adjacent the corner which is spaced from the corner so that the support bar of the first wall section is spaced from the support bar of the second wall section. Finally, engagement means are fixed to each wall section and engaged with each respective support bar for allowing lateral shifting between each wall section and each support bar, transmitting bending forces which tend to bend each wall section, to each respective buckstay which resists such bending forces, and for transmitting the weight of each buckstay to a respective wall section for supporting each buckstay on its respective wall section.

Another aspect of the present invention provides a corner plate welded to the tube wall and extending around the corner for reinforcing the corner and for transmitting forces between the first and second wall sections. Another aspect of the invention employs a slotted end connection corner tie, a pair of slotted end connection buckstay brackets, and a pair of end connection links to transmit loads from one buckstay to another only during a transient overpressure condition, but not during normal steam generator operation.

The various features of novelty which characterize the invention are pointed out with particularity in the claims annexed to and forming a part of this disclosure. For a better understanding of the invention, its operating advantages and specific results attained by its uses, reference is made to the accompanying drawings and descriptive matter in which preferred embodiments of the invention are illustrated.

BRIEF DESCRIPTION OF THE DRAWINGS

In the drawings:

FIGS. 5, 6, 7, 8, and 9 are each side elevational views of different geometries of the corner reinforcing plate of FIGS. 3 and 3B, the other side forming the corner reinforcing plate being a mirror image thereof;

DESCRIPTION OF THE PREFERRED EMBODIMENTS

Figure 3:
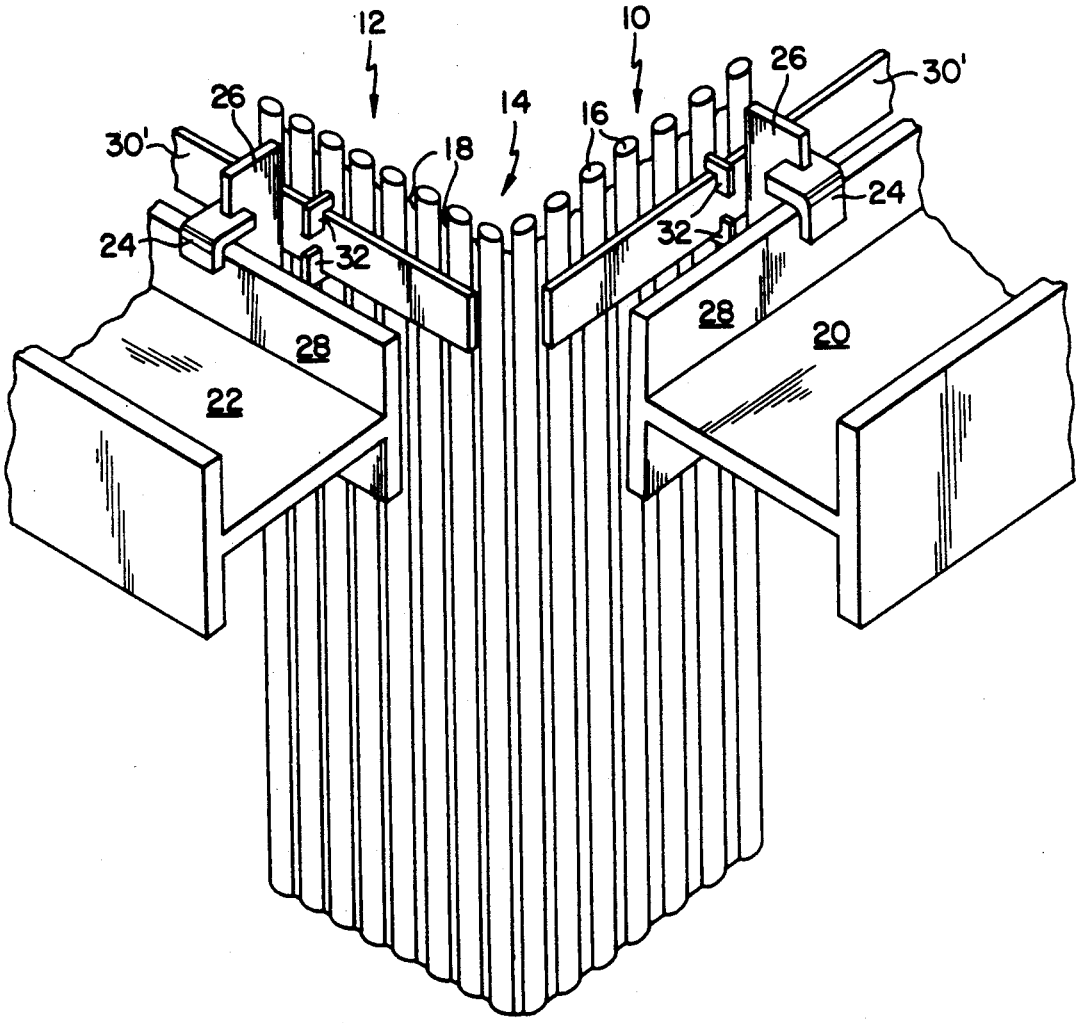
FIGS. 3, 3A, 3B and 3C are perspective views of several embodiments of the present invention showing various combinations of its several aspects.

Referring to the drawings generally, wherein like numerals designate the same element throughout the several drawings, and to FIG. 3 in particular, the invention embodied in FIG. 3 comprises a buckstay system for a membraned-tube wall having a first wall section 10 which meets a second wall section 12 at an angle to form a corner 14, and which utilizes the natural load carrying ability of membraned tube wall construction. Each wall section is comprised of multiple vertically extending tubes 16 which are spaced from and welded to each other by membrane plates 18, welded inbetween adjacent tubes 16.

The buckstay system of the present invention comprises at least one buckstay 20, 22 for each respective wall section 10, 12. In an actual boiler construction, buckstays 20, 22 are repeated at intervals along the vertical height of the wall sections 10, 12.

The purpose of the buckstays 20, 22 is to resist bending forces which the wall sections 10, 12 experience during boiler steady state and transient operating conditions, especially boiler start up and cool down. These bending forces are due to both external loads, such as wind and earthquake, and to boiler gas side pressure, which can be either positive or negative with respect to local atmospheric pressure.

Standoff means in the form of support lugs 24 and standoffs 26 are engaged along an inner flange 28 of each buckstay 20, 22. Relative lateral sliding or shifting movement between the standoff means 24, 26 and the buckstays 20, 22 is permitted to accommodate thermal expansion.

Figure 3A:
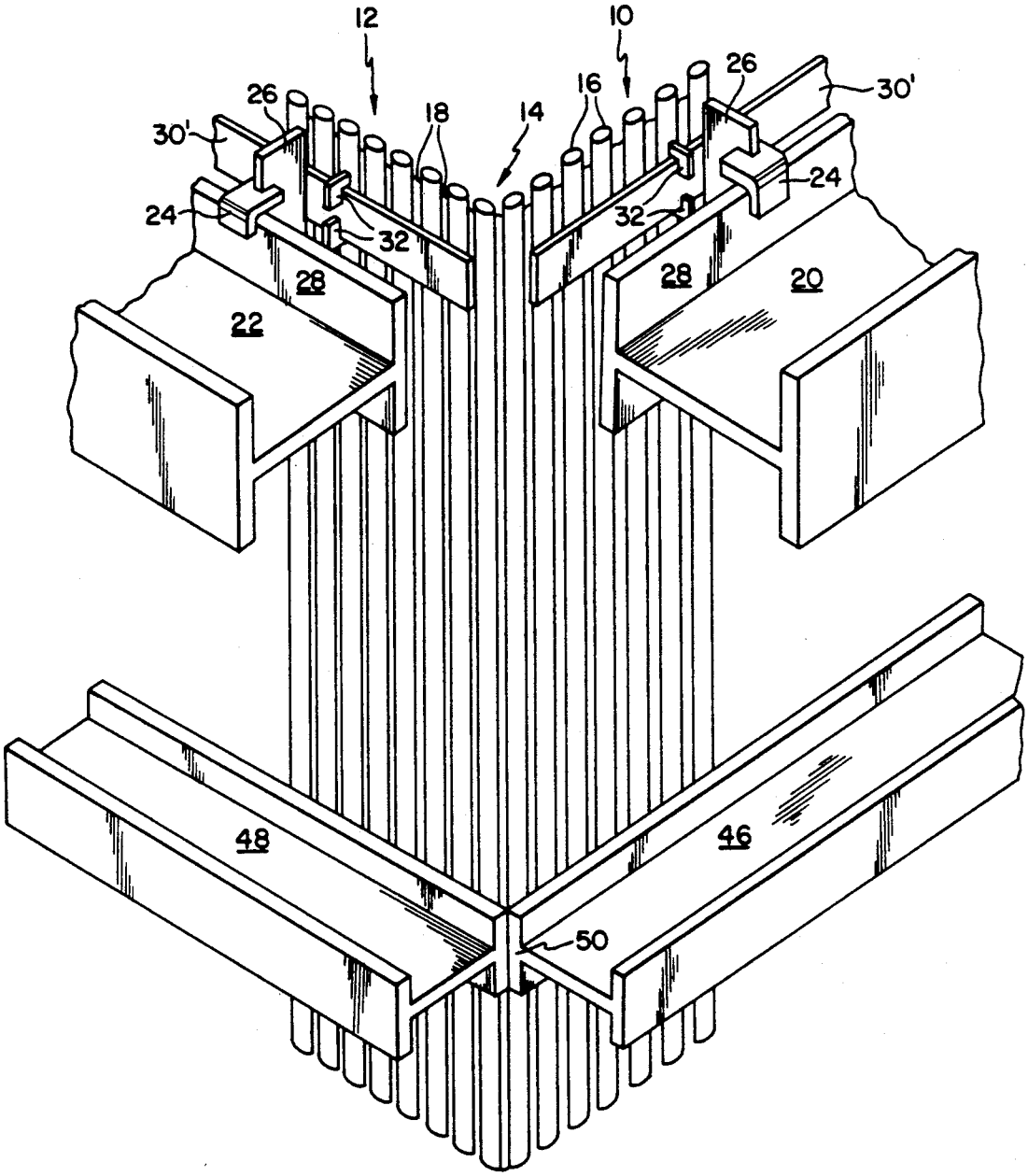
Figure 3B:
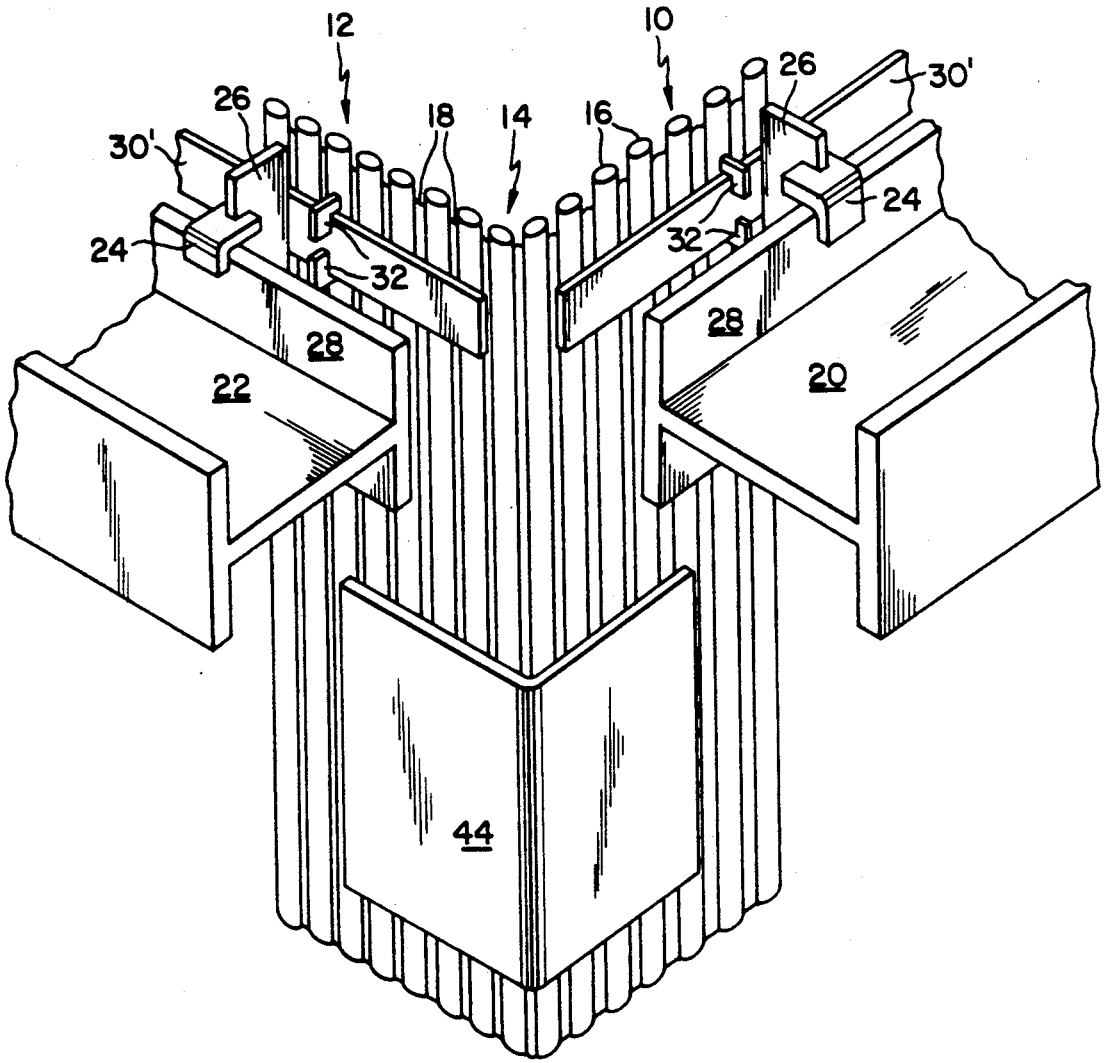
Figure 3C:
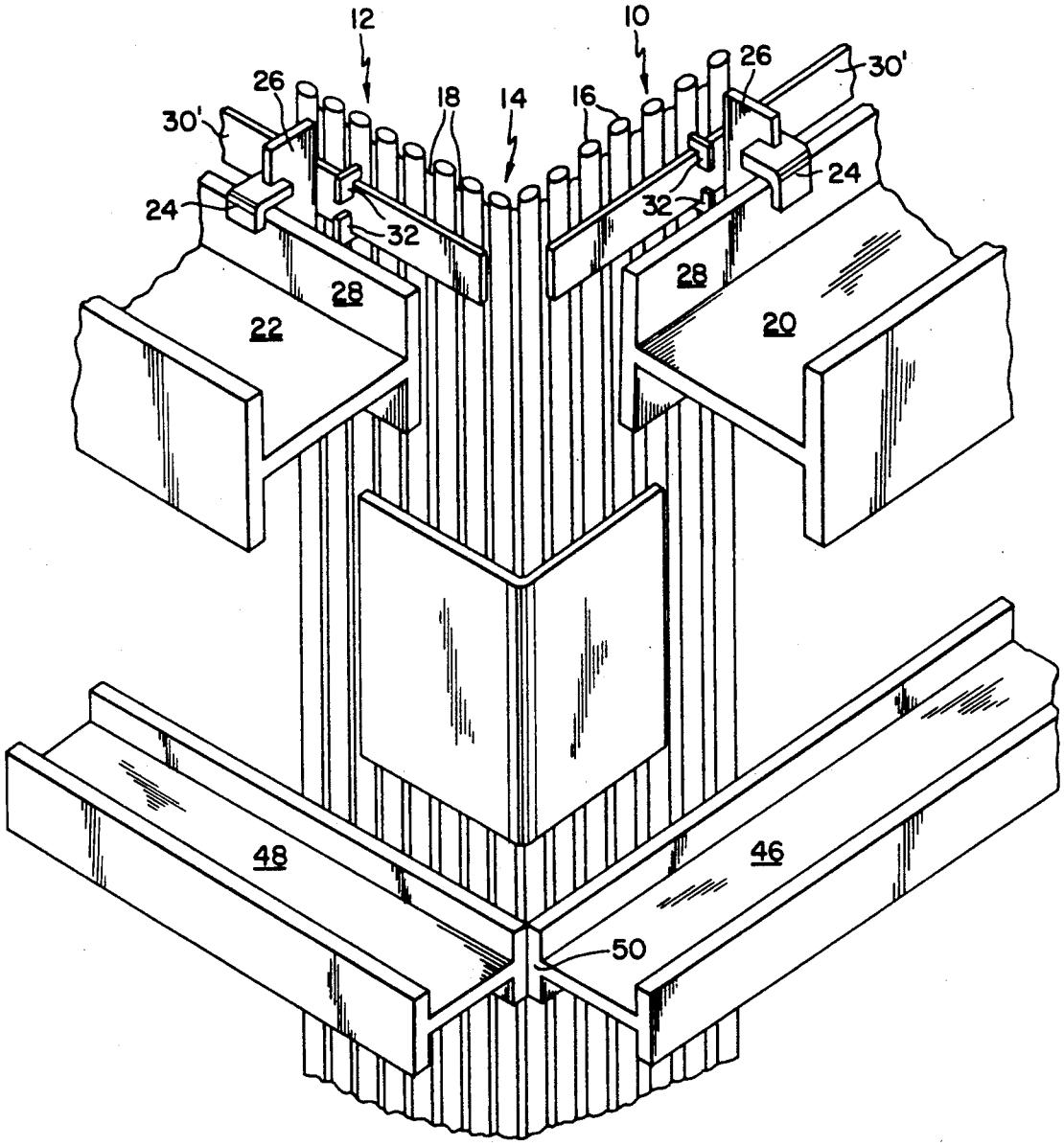

A support bar 30' is welded to the inside edge of each standoff 26. Engagement means in the form of L-shaped engagement lugs 32 are welded to the outside surface of some of the horizontally spaced tubes 16 forming each wall section 10, 12. The engagement lugs 32 are welded in facing pairs to form a slot which slidably, but closely, receives each support bar 30'. In this way, lateral sliding or shifting movement between the support bars 30' and the wall sections 10, 12 is accommodated, while still transmitting bending forces between the wall sections 10, 12 and the buckstays 20, 22. The engagement lugs 32 also support the weight of the buckstays 20, 22 which, in effect, hang on the wall sections 10, 12. FIG. 3A shows another aspect of the invention in which stiffening members 46, 48 are provided, engaged against the outer surface of the tubes forming the wall sections 10, 12 and extending to a point 50 at the corner 14 of the wall sections 10, 12. FIG. 3B shows another aspect of the invention, where means are provided for transmitting forces between the first and second wall sections, 10, 12 across the corner 14. As shown therein, one or more simple L-shaped reinforcing corner plates 44 are welded at vertically spaced locations along the corner 14 to the tubes 16 forming the wall sections 10, 12 and embrace the corner 14 to support it. FIG. 3C shows how the various features of FIGS. 3, 3A, and 3B can be combined together. It is understood that various combinations of the features of these aspects may be employed with or without a corresponding use of the other features.

Figure 4:
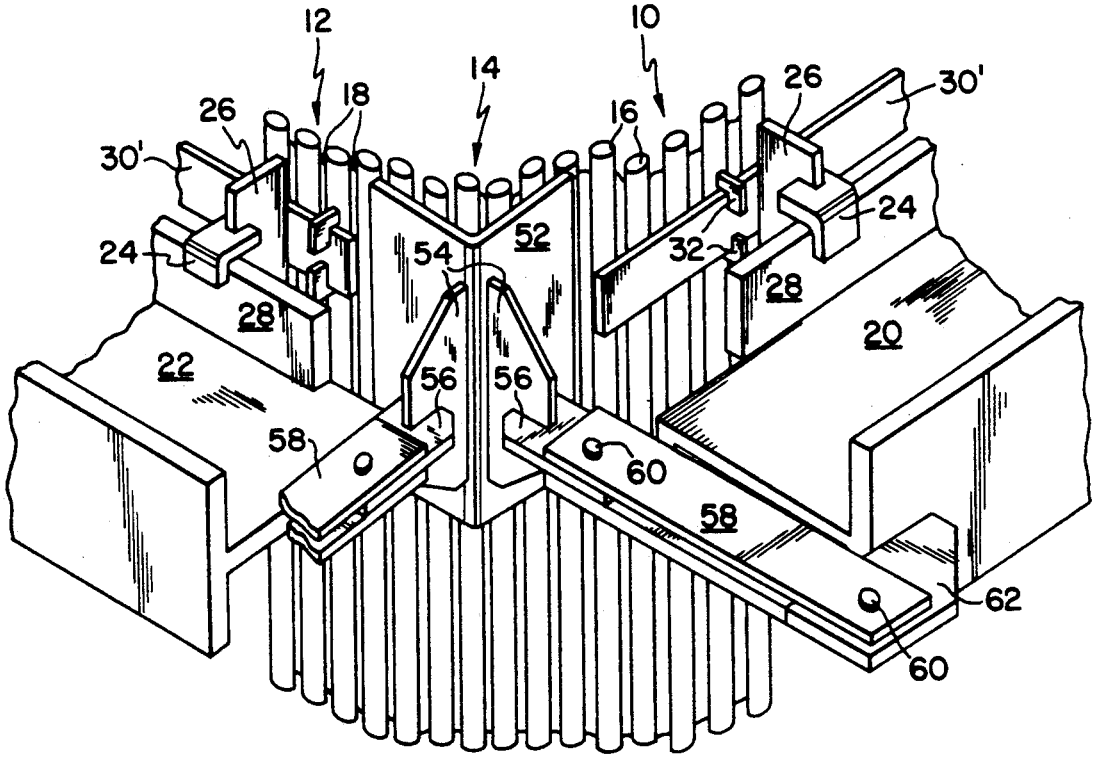
FIG. 4 is a perspective view, this time in the "hot" position, of another embodiment of the invention.

FIG. 4 shows another embodiment of the invention, in a "hot" condition. As shown therein, a corner plate 52 is welded to the outer surface of the tubes 16 forming the corner 14. Two pairs of gusset plates 54, 56 are welded to an outer surface of the corner plate 52. Each pair of gusset plates 54, 56 is pivotally connected to a pair of links 58 by means of pins 60. The opposite ends of each pair of links 58 are pivotally connected at another pin 60 to an end connection buckstay bracket 62, welded to an outer flange of the buckstays 20, 22. Links 58 are pivotally connected at pins 60.

FIGS. 5 through 9 illustrate various embodiments of the corner plate 44. FIG. 5 has a rectangular edge projection **44*a* and FIG. 9 has a curved edge projection 44*b*. Conversely, the embodiments of FIGS. 7 and 8 have rectangular and curved edge recesses 44*c*, 44*d***, respectively.

FIG. 6 illustrates a two part corner plate 44 with an upper shorter (vertically) L-shaped corner plate **44*e* and a lower longer (vertically) corner plate 44*f*. Each of the corner plates 44*e*, 44*f* are held against the corner of the tube wall by welding at various points to the outer surface of the tubes 16 forming the corner 14. If desired, the longer corner plate 44*f* can be above the shorter corner plate 44*e***.

Figure 10:
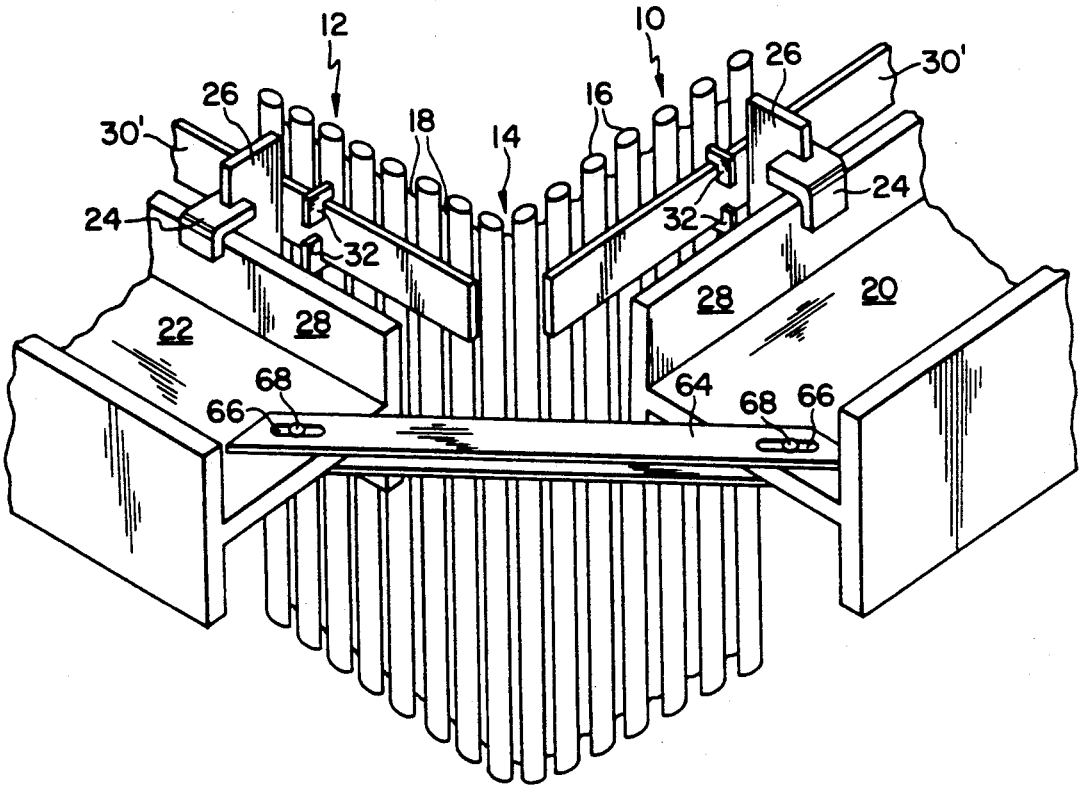
FIG. 10 is a perspective view similar to that of FIGS. 3, 3A, 3B, and 3C of another embodiment of the invention in which slotted links are connected directly between buckstays to provide for reinforcement only during a transient overpressure condition.

FIG. 10 illustrates another embodiment of the invention, similar to that of FIG. 3, in which additional reinforcement is provided only to accommodate transient overpressure conditions. A pair of slotted buckstay interconnecting links 64 span the corner 14 and are connected directly to the buckstays 20, 22. Each slotted buckstay interconnecting link 64 has a slot 66 at each end which receives pins 68 that slidably and rotatably, to a lesser degree, connect each interconnecting link 64 to the buckstays 20, 22. FIG. 10 shows the arrangement in a normal steam generator operating condition, the pins 68 being located roughly in the center of the length of each slot 66. The links 64 would thus only transmit load from one buckstay 20, to the other buckstay 22 in the event of a transient overpressure condition. While this type of slotted buckstay interconnecting link system has been employed in prior art, tangent tube wall constructions, to the best of the present inventor's knowledge, this construction has not previously been employed in membrane wall construction.

Figure 1:
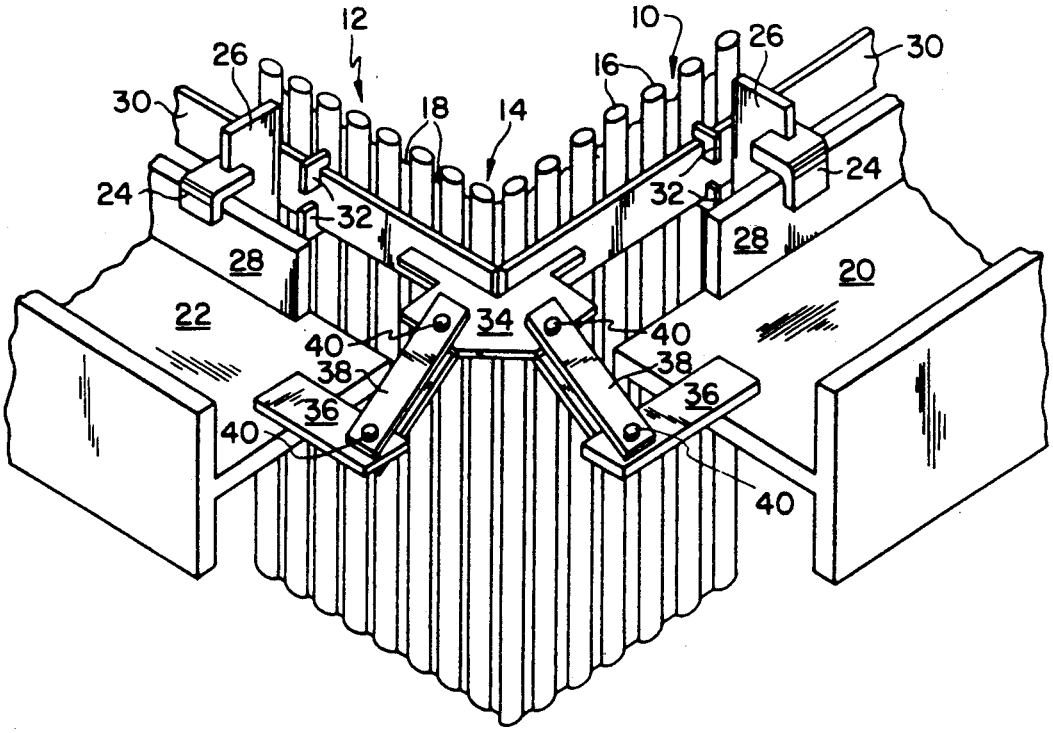
FIG.1 PRIOR ART
FIG. 1 is a perspective view of conventional, prior art buckstay system corner construction, shown in the "cold" position, utilizing a tie bar which extends continuously around the corner formed by two wall sections.
Figure 2:
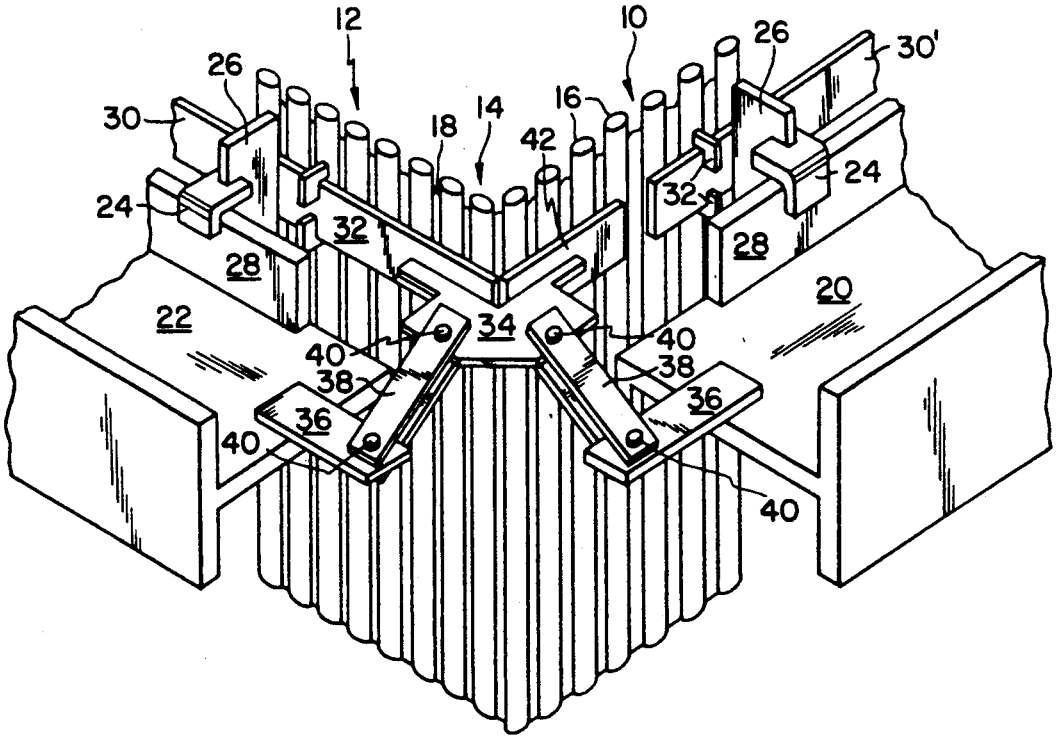
FIG.2 PRIOR ART
FIG. 2 is a perspective view of a conventional, prior art buckstay system corner construction, shown in the "cold" position, utilizing a tie bar which does not extend continuously around the corner.
Figure 11:
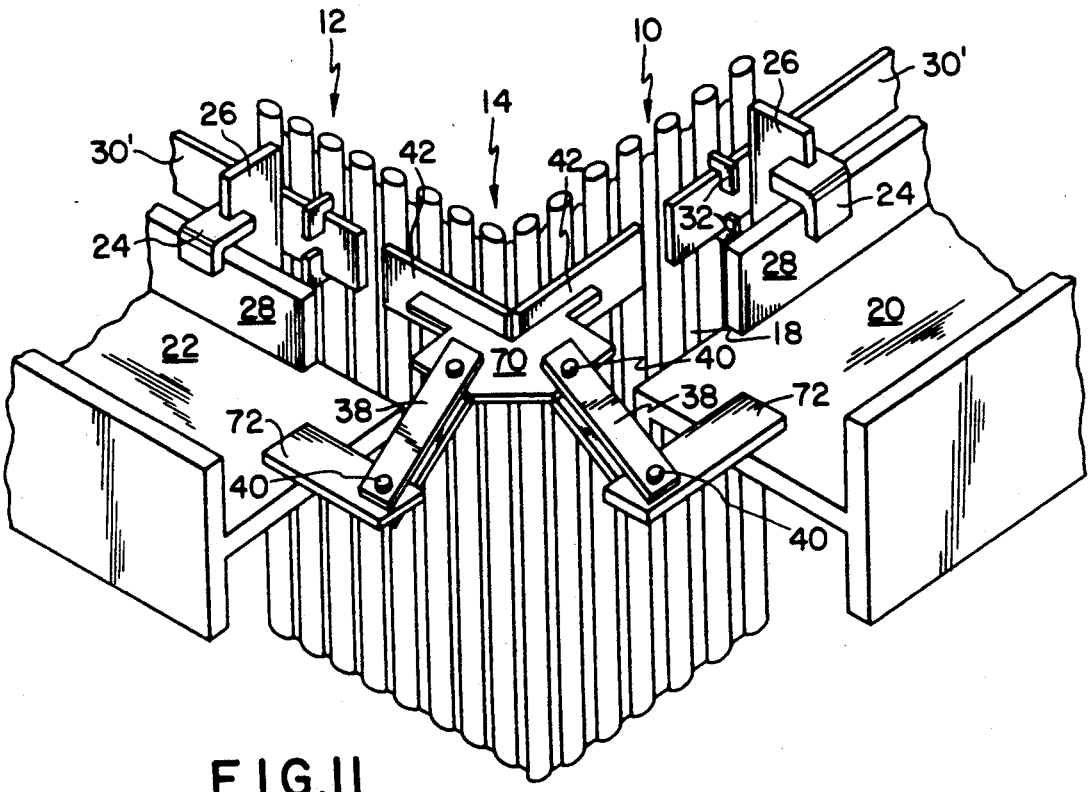
FIG. 11 is a perspective view similar to that of FIG. 2, again in the "cold" position, of another embodiment of the invention in which a slotted link system of buckstay end connections provides for reinforcement only during a transient overpressure condition.
Figure 12:
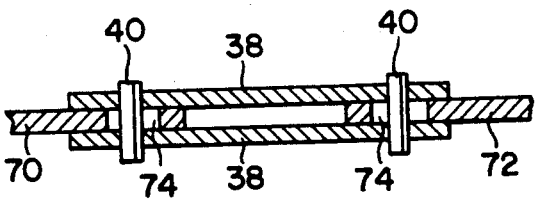
FIG. 12 is a sectional view of the links and connecting members in the embodiment of FIG. 11 for interconnecting the ends of the buckstays at a corner arrangement of the membrane tube wall.

FIGS. 11 and 12 illustrate another embodiment of the present invention. The arrangement is somewhat similar to that shown in FIG. 2. However, the embodiment in FIGS. 11 and 12 provides for transient overpressure condition reinforcement only, in a fashion similar to that disclosed in FIG. 10 above. A slotted end connection corner tie 70 spans the corner 12 and is welded to a pair of corner paddle ties 42 welded to each other at the corner 14 and to the tubes 16 forming the wall sections 10, 12. Slotted end connection buckstay brackets 72 are welded to each end of the buckstay 20, 22 near the corner 14. Slots 74 are provided in the slotted end connection corner tie 70 and in the slotted end connection buckstay brackets 72 which slidably receive pins 40 to secure each pair of end connection links 38. Again, the pins 40 would be located at mid travel of the slots 74 so that any load from the wall sections 10, 12 is only transmitted to the buckstay 20, 22 during a transient overpressure condition.

While specific embodiments of the invention have been shown and described in detail to illustrate the application of the principles of the invention, it will be understood that the invention may be embodied otherwise without departing from such principles.

What is claimed is:

1. A buckstay system for a membraned-tube wall of a steam generator having a first wall section which meets a second wall section at an angle to form a corner, and which utilizes the natural load carrying ability of membraned tube wall construction, alone, to facilitate distribution of combustion gas pressure loads from one wall section to the other, the system comprising:

at least one buckstay extending across at least part of each wall section;

standoff means engaged with each buckstay and extending toward each respective wall section;

a support bar connected to the standoff means of each buckstay, each support bar being engaged against and along at least part of the length of each respective wall section, each support bar having an end adjacent the corner which is spaced from the corner so that the support bar of the first wall section is spaced from the support bar of the second wall section;

engagement means fixed to each wall section and engaged with each respective support bar for allowing lateral shifting between each wall section and each support bar, and for transmitting bending forces which tend to bend each wall section, to each respective buckstay which resists such bending forces, and for transmitting the weight of each buckstay to a respective wall section for supporting each buckstay on its respective wall section.

2. A buckstay system according to claim 1, further including an L-shaped corner plate welded to the tube wall and extending around the corner for reinforcing the corner and for transmitting forces between the first and second wall sections.

3. A buckstay system according to claim 2, wherein each leg of the L-shaped corner plate has opposite vertical edges and a rectangular edge projection.

4. A buckstay system according to claim 2, wherein each leg of the L-shaped corner plate has opposite vertical edges and a curved edge projection.

5. A buckstay system according to claim 2, wherein each leg of the L-shaped corner plate has opposite vertical edges and a rectangular edge recess.

6. A buckstay system according to claim 2, wherein each leg of the L-shaped corner plate has opposite vertical edges and a curved edge recess.

7. A buckstay system according to claim 2, wherein the L-shaped corner plate is comprised of an upper and a lower L-shaped corner plate.

8. A buckstay system according to claim 2, wherein one of the upper and lower L-shaped corner plates is longer than the other.

9. A buckstay system according to claim 2, further including at least one stiffening member which extends along the full width of each tube wall and which are not connected at the corner to each other, to further stiffen each wall section.

10. A buckstay system according to claim 1, further including at least one stiffening member which extends along the full width of each tube wall and which are not connected at the corner to each other, to further stiffen each wall section.

11. A buckstay system according to claim 1, further comprising:

an L-shaped corner plate welded to the tube wall and extending around the corner for transmitting forces between the first and second wall sections; first and second gusset plates welded to an outer surface of the corner plate; and a pair of links each pivotally connected by means of a pin at one end to each gusset plate and at the other end by means of another pin to an end connection buckstay bracket that is welded to an outer flange of each buckstay.

12. A buckstay system according to claim 1, which also provides for reinforcement at the corner only during a transient overpressure condition, comprising:

a pair of slotted buckstay interconnecting links connected by pins directly to each buckstay, each interconnecting link having a slot located at each end thereof adapted to receive the pins, the length of the slot being selected so that loads from one buckstay are transmitted through the link to the other buckstay only during the transient overpressure condition, but not during normal steam generator operation.

13. A buckstay system for a membraned-tube wall of a steam generator having a first wall section which meets a second wall section at an angle to form a corner, which utilizes the natural load carrying ability of membraned tube wall construction, alone, to facilitate distribution of combustion gas pressure loads from one wall section to the other, and which also provides for reinforcement only during a transient overpressure condition, the system comprising:

at least one buckstay extending across at least part of each wall section;

standoff means engaged with each buckstay and extending toward each respective wall section;

a support bar connected to the standoff means of each buckstay, each support bar being engaged against and along at least part of the length of each respective wall section, each support bar having an end adjacent the corner which is spaced from the corner so that the support bar of the first wall section is spaced from the support bar of the second wall section;

engagement means fixed to each wall section and engaged with each respective support bar for allowing lateral shifting between each wall section and each support bar, and for transmitting bending forces which tend to bend each wall section, to each respective buckstay which resists such bending forces, and for transmitting the weight of each buckstay to a respective wall section for supporting each buckstay on its respective wall section and which provides for reinforcement only during the transient overpressure condition;

a pair of corner paddle ties welded to each other at the corner and to the tubes forming the wall sections, the corner paddle ties extending in alignment with the respective support bar of each wall section;

a slotted end connection corner tie welded at the corner to the pair of corner paddle ties;

a pair of slotted end connection buckstay brackets, one end of each welded to each end of the buckstays near the corner; and a pair of end connection links connected by pins at one end to the slots in the slotted end connection corner tie and at the other end to the slots in the slotted end connection buckstay bracket, the length of the slots being selected so that loads from one buckstay are transmitted through the links to the other buckstay only during the transient overpressure condition, but not during normal steam generator operation.

* * * * *